United States Patent [19]

Hendrikz

[11] 4,199,267

[45] Apr. 22, 1980

[54] TREATMENT OF SLURRIES AND LIQUIDS

[75] Inventor: John M. Hendrikz, Bristol, England

[73] Assignee: Imperial Group Limited, London, England

[21] Appl. No.: 941,789

[22] Filed: Sep. 12, 1978

[30] Foreign Application Priority Data

Sep. 20, 1977 [GB] United Kingdom ..... 39039/77

[51] Int. Cl.² ..... B01F 5/00; B01F 15/00

[52] U.S. Cl. ..... 366/302; 366/176

[58] Field of Search ..... 366/302, 303, 304, 305, 366/306, 307, 336, 255, 256, 260, 176

[56] References Cited

U.S. PATENT DOCUMENTS

| | | | |
|---|---|---|---|
| 1,468,226 | 9/1923 | Colburn et al. | 366/302 X |
| 1,727,417 | 9/1929 | Soule | 366/302 X |
| 2,435,216 | 2/1948 | Hofmann | 366/302 |
| 2,441,711 | 5/1948 | McFadden | 366/302 X |
| 2,491,231 | 12/1949 | Travis et al. | 366/302 |
| 2,546,745 | 3/1951 | Hein | 366/336 X |
| 3,179,385 | 4/1965 | Deackoff | 366/176 X |
| 3,473,787 | 10/1969 | Bartlett | 366/176 |

FOREIGN PATENT DOCUMENTS

| | | | |
|---|---|---|---|
| 156001 | 4/1954 | Australia | 366/176 |
| 555098 | 3/1958 | Canada | 366/176 |

*Primary Examiner*—Stanley N. Gilreath

*Attorney, Agent, or Firm*—Larson, Taylor and Hinds

[57] ABSTRACT

Abrasive-containing tobacco slurry is homogenized by passing radially outwards between the facing surfaces of two closely adjacent coaxial rings of tungsten carbide to impinge violently against a tungsten carbide surface surrounding the rings. The occurrence of local areas of wear in the facing surfaces is minimized by rotating one ring relative to the other.

7 Claims, 3 Drawing Figures

TREATMENT OF SLURRIES AND LIQUIDS

Figure 1:
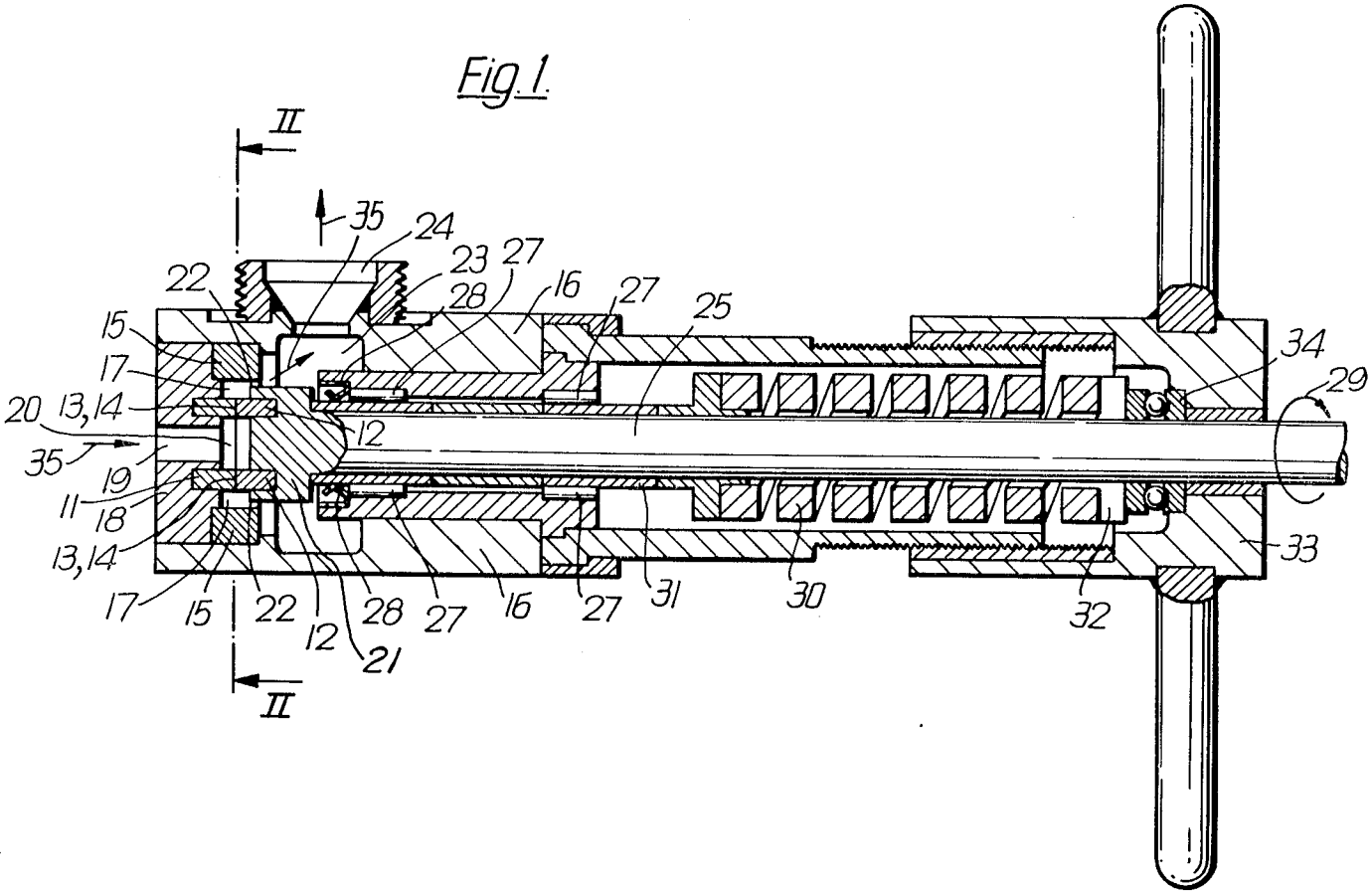

This invention relates to the treatment, specifically homogenization of slurries and liquids which are either contaminated by or contain abrasive materials.

The type of homogenising action to which the invention is applicable is that whereby slurry or liquid is forced under high pressure through a small orifice to impinge at very high velocity against an impact surface set perpendicular to the direction of flow through the orifice. Under these conditions of high velocity and impact, high shear and cavitation forces occur which disintegrate the solids in the slurry and/or disperse and intimately mix them in the slurry. Similarly, this method may be used to homogenise two otherwise immiscible liquids.

One apparatus for giving effect to this method comprises a pair of facing coaxial rings made of very hard material and having facing parallel flat annular surfaces. The rings are pressed together by a spring so that the annular surfaces come into intimate contact. The bore of one ring is closed off. Fluid to be homogenised, such as a slurry or liquid, is fed under high pressure through the bore of the other ring so that the annular surfaces of the rings are separated against the resistance of the spring to provide a very narrow orifice through which the fluid escapes radially at a very high velocity and pressure. The fluid, on escaping from between the rings, then impinges against the inner surface of a third or impact ring which surrounds the first two or orifice rings but is separated from them.

It is found when attempting to homogenise fluids containing abrasive materials with this system that after a relatively short time wear grooves and erosion channels are formed radially across the facing annular surfaces of the orifice rings. The wear grooves and erosion channels reduce the velocity of fluid through the orifice and impair the homogenising action. In turn these grooves and channels allow free passage of fluid through the orifice causing excessive pitting in the impact ring. Loss of homogenising pressure is indicative of the formation of the aforesaid grooves and channels.

Once the grooves and channels start to occur, the flatness of the facing surfaces of the orifice rings must be restored. This may be done by regrinding the worn surfaces to a flat profile; this may be repeated several times depending on the depth of the grooves and channels and hence on the depth of the surface that must be removed to regain a flat surface. The impact ring cannot be reconditioned and must be replaced when excessively pitted.

It is an object of the present invention to extend the useful life of the orifice rings by a considerable amount without recourse to frequent dismantling and regrinding of the orifice rings.

According to one aspect of the presention invention there is provided a method of minimizing the occurrence of local areas of wear in two parallel surfaces between which a fluid or abrasive substance is being passed comprising rotating one surface relative to the other about an axis perpendicular to the plane of parallelity. The surfaces may be flat, and may be two adjacent annular surfaces relatively rotatable about a common axis.

According to a second aspect of the presention invention there is provided a homogenizing apparatus comprising two closely spaced parallel surfaces, means for feeding a fluid to be homogenized between the surfaces, and means for rotating one surface relative to the other about an axis perpendicular to the plane of parallelity.

According to a third aspect of the present invention there is provided a homogenizing apparatus comprising a facing pair of coaxial rings having facing parallel flat annular surfaces, means for resiliently pressing the rings together so that the facing surfaces come into contact, means for supplying fluid to be homogenized under pressure axially through the bore of one ring, the bore of the other ring being closed, whereby fluid entering under pressure through the bore of said one ring is forced radially outwards between the facing surfaces, characterised in that means is provided to cause relative rotation between the rings about their common axis whereby the facing surfaces become self-lapping. Preferably, one ring is maintained stationary and the other is rotated.

Figures 2, 3:
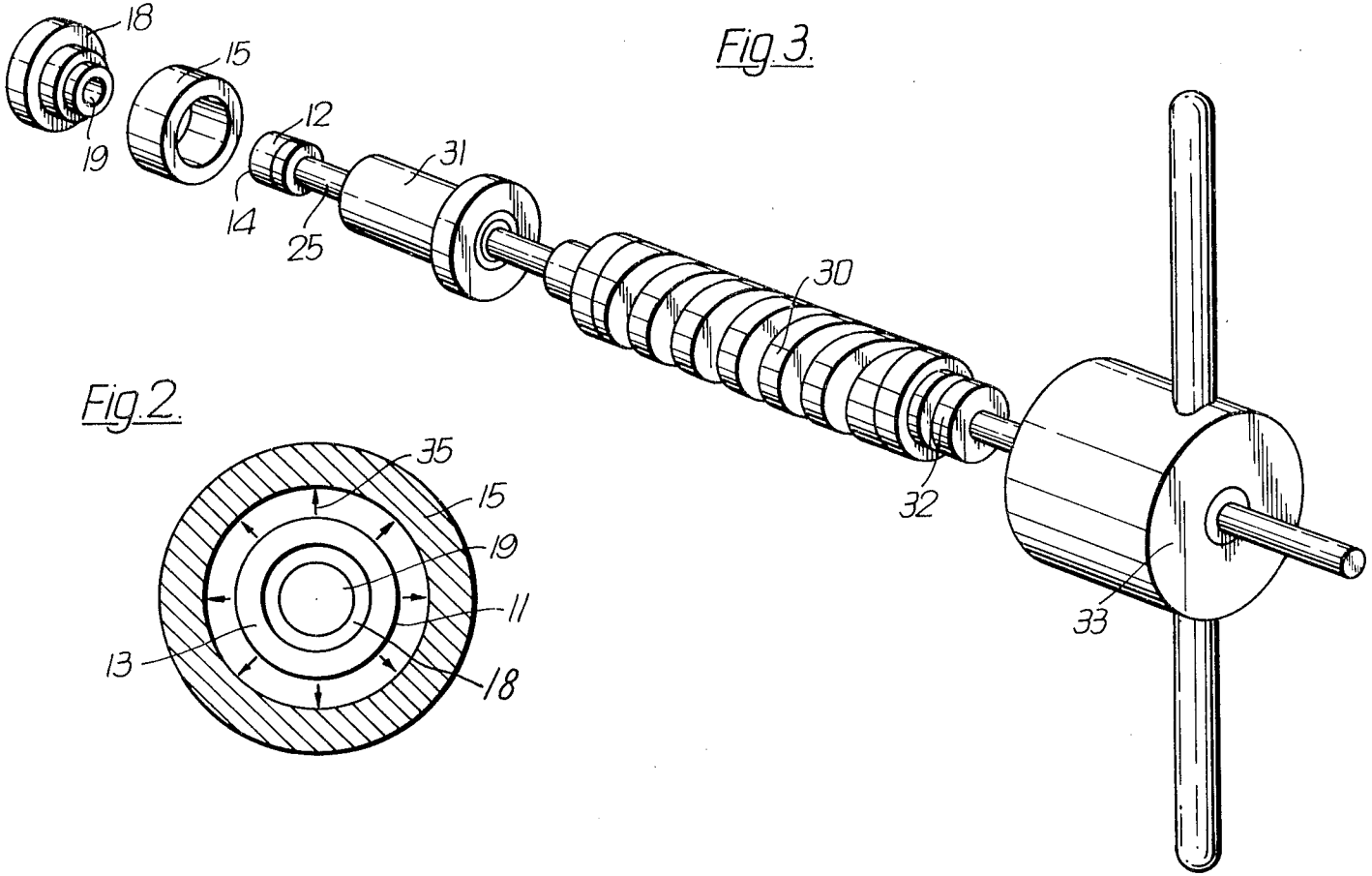

The invention will now be described by way of example with reference to the accompanying diagrammatic drawings in which, FIG. 1, is an axial cross-section of a homogenizer, FIG. 2 is a cross-section of a portion of the homogenizer of FIG. 1 taken at the line II—II, and, FIG. 3 is an exploded perspective view of the homogenizer of FIG. 1.

Referring to the drawings there is shown in its essentials a homogenizer 10 suitable for homogenizing tobacco slurry. The homogeniser comprises a coaxial pair of identical or closely similar tungsten carbide rings 11, 12 (hereinafter referred to as "orifice rings"), the respective annular facing surfaces 13, 14 of which are machined flat and perpendicular to the common axis of the orifice rings. Accordingly, when the orifice rings are brought together along their common axis, the faces 13, 14 come into intimate contact. Typical dimensions of the rings are, outside diameter 28 mm, inside diameter 19 mm, depth 10 mm.

Surrounding, spaced from, and coaxial with the orifice rings is a third tungsten carbide ring 15, hereinafter referred to as the "impact ring", mounted on the inside of an outer cylindrical metal casing 16. The inside of the impact ring together with the outside of the orifice rings defines an annular space 17.

One of the orifice rings, 11, is set in a cylindrical metal block 18 mounted in one end of the casing 16 and provided with an axial inlet aperture 19 coaxial with the orifice rings and leading into the space 20 enclosed by the orifice rings.

The second orifice ring, 12, is mounted in a non-apertured cylindrical metal block 21 which closes off the central bore of ring 12.

The outside diameter of block 21 is less than the inside diameter of the impact ring 15. Block 21 defines with the impact ring 15 an annular passage 22 leading to an annular space 23 defined between block 21 and the interior surface of the casing 16. The casing 16 is provided with an aperture 24 communicating with annular space 23.

Block 21 is mounted on one end of a drive shaft 25 mounted for axial rotation by needle bearings 27 sealed against pressure by oil seals 28 at the end nearest block 21. The shaft 25 is rotated in the direction indicated by arrow 29 by a motor or other means not illustrated. Hence, rotation of shaft 25 causes rotation of orifice ring 12 relative to orifice ring 11.

Ring 12 is held in compression against ring 11 by a compression spring 30 encircling the drive shaft 25 and acting between a sleeve 31 abutting against block 21 and a sleeve 32 spaced further from the block 21. The spring 30 is compressed by a handwheel 33 acting against sleeve 32 by means of a thrust race 34, thereby enabling the shaft to rotate independently of the turning of the handwheel as the spring is compressed to any desired degree.

In operation, tobacco slurry is fed through the aperture 19 in block 18 into the space 20 enclosed by the orifice rings 11, 12 under very high pressure, typically 280 kg/cm$^2$. The drive shaft 25 is rotated at speeds of between 1 and 60 rpm. The slurry is forced against the compression of the spring 30 between the contacting faces 13, 14 of the orifice rings, thereby separating the faces by an infinitesimal amount to form a minute annular orifice, and is ejected at very high velocity into the annular space 17 between the orifice rings and the impact ring to impinge violently against the impact ring. The forcing of slurry between the orifice rings and the ejection against the impact ring causes homogenisation of the slurry. The homogenized slurry leaves the annular space 17 via passage 22 to enter the larger annular space 23 between block 21 and outer casing 16, which space it leaves through aperture 24 in the outer casing. The path of the slurry is indicated by arrows 35.

The rotary action of the orifice rings has two effects. Firstly, it prevents channeling across the annular faces of the rings, which in turn prevents extensive pitting of the impact ring and promotes even wear, and secondly, it causes the annular faces of the rings to become self-lapping.

Initial wear is similar to that described for conventional orifice rings and is evident from the shallow radial grooves on the working annular faces of the rings. If the abrasive slurry or liquid were allowed to run freely along these grooves the same eroding action, as above, would continue until deep channels had been cut, but, because of the rotary action of the rings, wear does not occur in exaggerated deep channels but is evenly distributed over the whole working annular face of each ring.

It has not been found necessary to regrind the annular surfaces of the orifice rings. The effective life of the rings is extended such that failure due to pitting and channeling is eliminated.

Although the invention applied to the homogenising of any slurry or liquid which causes wear of the orifice rings and impact ring it is applicable particularly to the processing of the tobacco slurries during the making of a reconstituted tobacco web from waste tobacco.

Waste tobacco fines may be reconstituted into a useable form by reducing the particle size of the material, in the presence of water, to form a slurry. The slurry may then be found into a web by known casting techniques.

The waste tobacco fines are generated during the manufacture of cigars and cigarettes and are typically comprised of fines, suction dusts and floor sweepings. This material is contaminated with silica and other factory debris. The abrasive nature of this contamination destroys the cutting surfaces of the particle size reduction equipment, which typically comprises wet hammer mills and homogenisers.

The silica content of the waste can be as high as 8%. Sieving techniques can be used to reduce the level of contamination to 3% silica but further reduction is, at present, impracticable. This reduced level of contamination still causes excessive wear on the homogenizing equipment.

Typically an APV Manton Gaulin Homogeniser is used to reduce, disperse and homogenise the tobacco slurry at a pressure of 280 kg/cm$^2$. With conventional orifice rings made from tungsten carbide wear grooves and erosion channels as deep as 0.5 mm normally occur after only one hour of operation. Corresponding to these grooves and channels are deep eroded pits in the impact ring surface which can be up to about 2 mm in depth compared to the normal uniform erosion groove running around the impact ring surface of about 0.2 mm. At this stage the pressure at the orifice is reduced to about 70 kg/cm$^2$ and the homogenising action seriously impaired. The rings must then be replaced. In practice the worn annular faces are reground after removal to again present a flat even surface and generally it is possible to accommodate 20 regrinds per ring giving a total life of 20 hours.

Using the rotating ring assembly of the present invention at speeds of between 1 and 60 rpm for the same tobacco slurry a homogenised final product is produced similar to that produced by conventional rings in good condition. After 1 hour of processing using the rotating rings processing wear was apparent as numerous narrow and shallow radial grooves of about 0.01 mm deep$\times$0.01 mm wide but these sustained a homogeniser pressure of 280 kg/cm$^2$ and a good final product. After a further 5 hours running the wear was similar and still only apparent as numerous narrow and shallow grooves of 0.01 mm. The overall tungsten carbide material lost from the annular faces by the self lapping action was indeterminable after this 5 hour period.

The corresponding wear in the impact ring was completely uniform and even and in the form of a narrow and shallow groove of about 0.3 mm deep running around the impact ring surface.

In alternative embodiment of the invention orifice ring 12 may be kept stationary and ring 11 rotated, or both rings may be rotated in contrary directions. The speed of rotation may be extended beyond the range 1–60 rpm to suit specific requirements.

I claim:

1. A method of homogenizing a tobacco slurry containing solid abrasives comprising rotating first and second coaxial rings of a hard material having facing parallel flat annular surfaces relative to one another about their common axis; pressing the annular surfaces of the first and second coaxial rings resiliently one against the other so that the two faces are worked together to a very close fit and are self lapping; passing the slurry containing abrasives radially outwards under very high pressure of the order of 280 kg/cm$^3$ between the facing surfaces of the two closely adjacent and rotating coaxial rings; and causing the slurry to impinge violently against a surface spaced from, surrounding and coaxial with said rings.

2. A homogenizing apparatus for a slurry containing solid abrasive materials comprising first and second coaxial rings having facing parallel flat annular surfaces, means for resiliently pressing said rings together so that the facing surfaces come into contact, a third ring surrounding and spaced from the first and second rings, the inside surface of the third ring together with the outside surfaces of said first and second rings defining an annular space, means for causing relative rotation between the first and second rings about their common axis whereby the facing surfaces of said first and second rings become self lapping so as to work said facing surfaces together to a very close fit, and means for supplying the slurry containing abrasive to be homogenized under pressure axially through the bore of said first ring, the bore of said second ring being closed, whereby fluid entering under pressure through the bore of said first ring is forced radially outwards between the facing surfaces of said first and second rings and the rotary action of the first and second rings with the abrasive containing slurry passing therethrough promotes self lapping and prevents the formation of erosion channels and pitting in the rings and the slurry containing abrasive passes outward between the first and second rings and impinges violently against the inside surface of said third ring.

3. Apparatus as claimed in claim 2 wherein one of said first and second rings is rotated and the other is maintained stationary.

4. Apparatus as claimed in claim 2 wherein the means for resiliently pressing the rings together comprises an adjustable compression spring located coaxially with and between said second ring and a fixed member.

5. Apparatus as claimed in claim 2 wherein the means for causing relative rotation comprises a rotatable shaft arranged to rotate said second ring.

6. Apparatus as claimed in claim 2 for homogenising abrasive-containing tobacco slurry wherein the rings are made from material harder than the abrasive.

7. Apparatus as claimed in claim 6 wherein the material is tungsten carbide.

* * * * *